US006736762B2

(12) United States Patent
Chen

(10) Patent No.: US 6,736,762 B2
(45) Date of Patent: May 18, 2004

(54) EXERCISER HAVING HANDLE FOR ADJUSTING RESISTANCE

(76) Inventor: Paul Chen, 7771 Goldstread Dr., Richmond, Vancouver, BC (CA), V7A 1S5

( * ) Notice: Subject to any disclaimer, the term of this patent is extended or adjusted under 35 U.S.C. 154(b) by 92 days.

(21) Appl. No.: 10/134,998

(22) Filed: Apr. 30, 2002

(65) Prior Publication Data

US 2003/0203791 A1 Oct. 30, 2003

(51) Int. Cl.[7] ..... A63B 27/06
(52) U.S. Cl. ..... 482/63; 482/57; 482/52
(58) Field of Search ..... 482/51–53, 57–65, 482/70, 71, 114–118, 110

(56) References Cited

U.S. PATENT DOCUMENTS 3,727,913 A * 4/1973 Glaser et al. ..... 482/62
4,586,706 A * 5/1986 Chen ..... 482/62
4,898,379 A 2/1990 Shiba ..... 272/73
5,016,870 A * 5/1991 Bulloch et al. ..... 482/62
5,031,901 A 7/1991 Saarinen ..... 272/73
5,180,347 A 1/1993 Chen ..... 482/5
6,273,845 B1 8/2001 Liou ..... 482/63

* cited by examiner

*Primary Examiner*—Stephen R. Crow
(74) *Attorney, Agent, or Firm*—Charles E. Baxley

(57) ABSTRACT

An exerciser includes a rotary member rotatably supported on a base and driven by foot pedals, a handle stem pivotally supported on the base, and a brake cable engaged around the rotary member and having one end coupled to the handle stem. The brake cable is arranged to be moved away from and toward the rotary member when the handle stem is rotated relative to the base. The brake cable may be loosen relative to the rotary member when the handle stem is rotated away from the users, and may be forced against the rotary member when the handle stem is rotated toward the users.

14 Claims, 7 Drawing Sheets

EXERCISER HAVING HANDLE FOR ADJUSTING RESISTANCE

BACKGROUND OF THE INVENTION

1. Field of the Invention

The present invention relates to an exerciser, and more particularly to an exerciser having a pivotal handle for adjusting the resistance force applied to the exerciser.

2. Description of the Prior Art

Typical exercisers, such as the cycles, the stepping exercisers, or the like, may include one or more wheels or rotary members attached thereon. For example, the wheels or the rotary members may be rotated and driven by the cranks and the foot pedals of the cycles, or may be rotated and driven by the foot pedals of the stepping exercisers when the foot pedals are moved or actuated by the users. Some of the exercisers may include a tension belt or a brake band, or a brake belt or the like engaged around the wheels or the rotary members for braking purposes.

U.S. Pat. No. 5,031,901 to Saarinen discloses one of the cycle exercisers including a brake cable actuated brake device which includes a motorized driving mechanism for driving or pulling or actuating the brake cable. The brake cable may not be actuated or operated by a pivotal handle stem.

U.S. Pat. No. 5,180,347 to Chen discloses the other cycle exercisers including a motorized actuating device coupled to the brake belt, in order to actuate the brake belt relative to the wheels or the rotary members, and so as to adjust the brake force against the rotary members. However, the motorized actuating device include a complicated and expensive configuration that may not be easily manufactured and assembled and marketed. The brake cable also may not be actuated or operated by a pivotal handle stem.

U.S. Pat. No. 4,898,379 to Shiba, and U.S. Pat. No. 6,273,845 to Liou discloses the further cycle exercisers including a disc brake device actuatable or operatable by a brake cable. The brake cable also may not be actuated or operated by a pivotal handle stem. Accordingly, the handles of the typical exercisers may not be used to adjust the brake force against the wheels or the rotary members.

The present invention has arisen to mitigate and/or obviate the afore-described disadvantages of the conventional exercisers.

SUMMARY OF THE INVENTION

The primary objective of the present invention is to provide an exerciser including a simplified configuration having a pivotal handle for adjusting the resistance force applied to the exerciser.

In accordance with one aspect of the invention, there is provided an exerciser comprising a base, a first rotary member rotatably supported on the base, means for driving the first rotary member, a handle stem pivotally supported on the base with a pivot pin and rotatable relative to the base about the pivot pin, and a brake cable engaged around the first rotary member, and including a first end coupled to the handle stem. The brake cable is arranged to be moved away from and toward the first rotary member when the handle stem is rotated relative to the base. For example, the brake cable may be become loose relative to the first rotary member when the handle stem is rotated forward or away from the users, similar to riding or cruising down a hill; and the brake cable may be forced toward or further against the first rotary member when the handle stem is rotated rearward or toward the users, similar to riding or climbing up a hill.

A housing may further be provided on the base, the handle stem may be pivotally supported on the housing with the pivot pin and rotatable relative to the housing and the base about the pivot pin. The first rotary member is rotatably secured to the housing.

The driving means includes a second rotary member rotatably supported on the base, and means for coupling the second rotary member to the first rotary member which includes a third rotary member secured to the first rotary member, and a coupling member engaged around the third and the second rotary members.

A device may further be provided for rotating the second rotary member, and may include a pair of cranks and foot pedals coupled to the second rotary member for rotating the second rotary member. A device may apply a resistance force against the handle stem.

A hand grip may further be provided and pivotally secured to the handle stem, and a lever pivotally secured between the hand grip and the base and parallel to the handle stem. A link may be pivotally coupled between the handle stem and the lever.

A sleeve is further provided and slidably engaged on the lever, the link being pivotally coupled between the handle stem and the sleeve.

A device may further be provided for adjustably securing the sleeve on the lever, to adjustably securing the handle stem and the lever to the base at a selected angular position.

A device may further be provided for applying a resistance force against the lever. For example, a post is extended from the base, and a resilient member may be coupled between the post and the lever.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
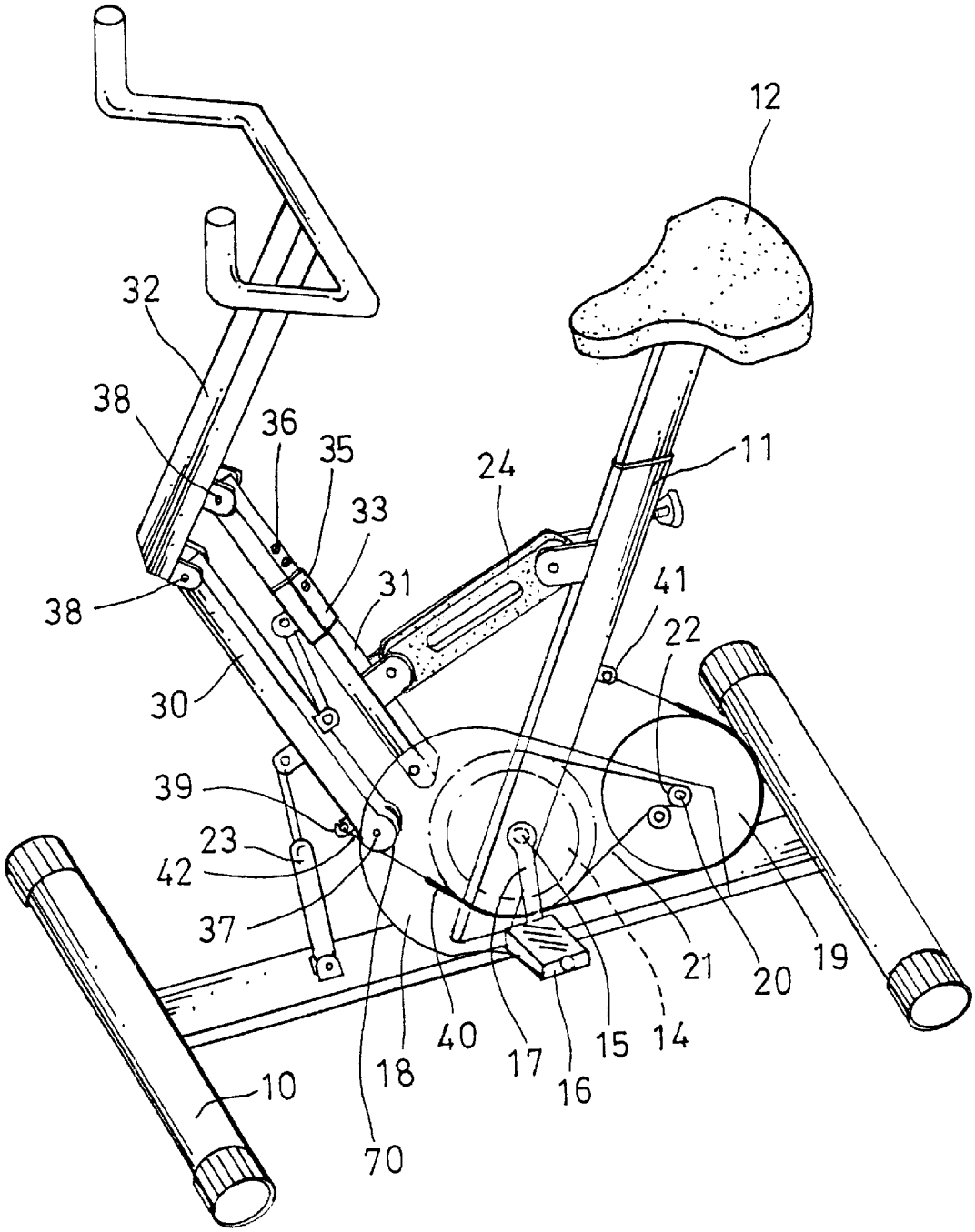
FIG. 1 is a perspective view of an exerciser in accordance with the present invention.
Figure 2:
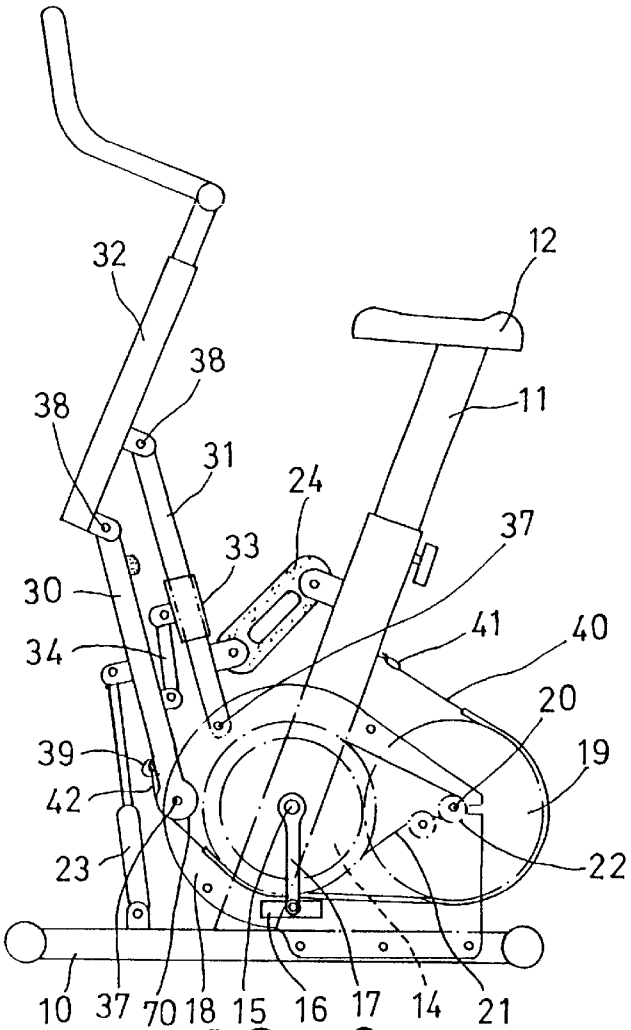
FIG. 2 is a plan schematic view of the exerciser.

Referring to the drawings, and initially to FIGS. 1–5 an exerciser in accordance with the present invention comprises a base 10, a post 11 extended upward from the base 10 and including a seat cushion 12 disposed thereon for supporting the users, a rotary member 14 such as a sprocket or a pulley or a wheel rotatably attached to the base 10 or to the post 11 with a pivot axle 15, and a pair of foot pedals 16 attached to the pivot axle 15 and/or the rotary member 14 with cranks 17 in order to rotate or to drive the rotary member 14. The base 10 may includes a housing 18 secured thereon for covering and shielding the rotary member 14 and/or for decorative purposes.

Another rotary member 19, such as a sprocket or a pulley or a wheel, may further be provided and rotatably attached to the base 10 or to the housing 18 with a pivot shaft 20. The rotary member 19 includes such as a sprocket or a wheel or a pulley 22 secured thereto and rotated in concert with the rotary member 19. A chain or a belt or a coupling member 21 or the like is engaged around the rotary members 14, 22 for allowing the rotary members 22, 19 to be rotated and driven by the foot pedals 16 via the cranks 17 and the rotary member 14.

A handle stem 30 includes one end pivotally secured to the base 10 or the housing 18 with a pivot pin 37, and a hand grip 32 includes a lower end pivotally secured to the other end of the handle stem 30 with another pivot pin 38. The handle stem 30 may thus be rotated relative to the housing 18 or the base 10 about the pivot pin 37. A lever 31 may further be provided and pivotally coupled between the base 10 or the housing 18 and the hand grip 32 with pivot pins 37, 38, and is preferably parallel to the handle stem 30, for allowing the handle stem 30 and the lever 31 to form the two parallel sides of a parallelogram.

A sleeve 33 may be slidably engaged onto the lever 31, and a link 34 is pivotally coupled between the handle stem 30 and the lever 31, for further stably retaining the lever 31 in the parallel position relative to the handle stem 30, or for further maintaining the handle stem 30 and the lever 31 in or as the two parallel sides of the parallelogram. The sleeve 33 may be caused to be moved along the lever 31 when the handle stem 30 and the lever 31 are rotated relative to the base 10 or the housing 18.

A resilient member or an actuator 23 may further be provided and secured between the handle stem 30 and the base 10 or the housing 18 for applying a resistive force against the handle stem 30 and thus the lever 31 and the hand grip 32. Another actuator or a resilient member 24 may further be provided and secured between the lever 31 and the base 10 or the housing 18 or the post 11 for applying a resistive force against the lever 31 and thus the handle stem 30 and the hand grip 32. The actuators 23 and/or the resilient members 24 may optionally, but not necessarily be provided and attached to the exerciser.

Figure 8:
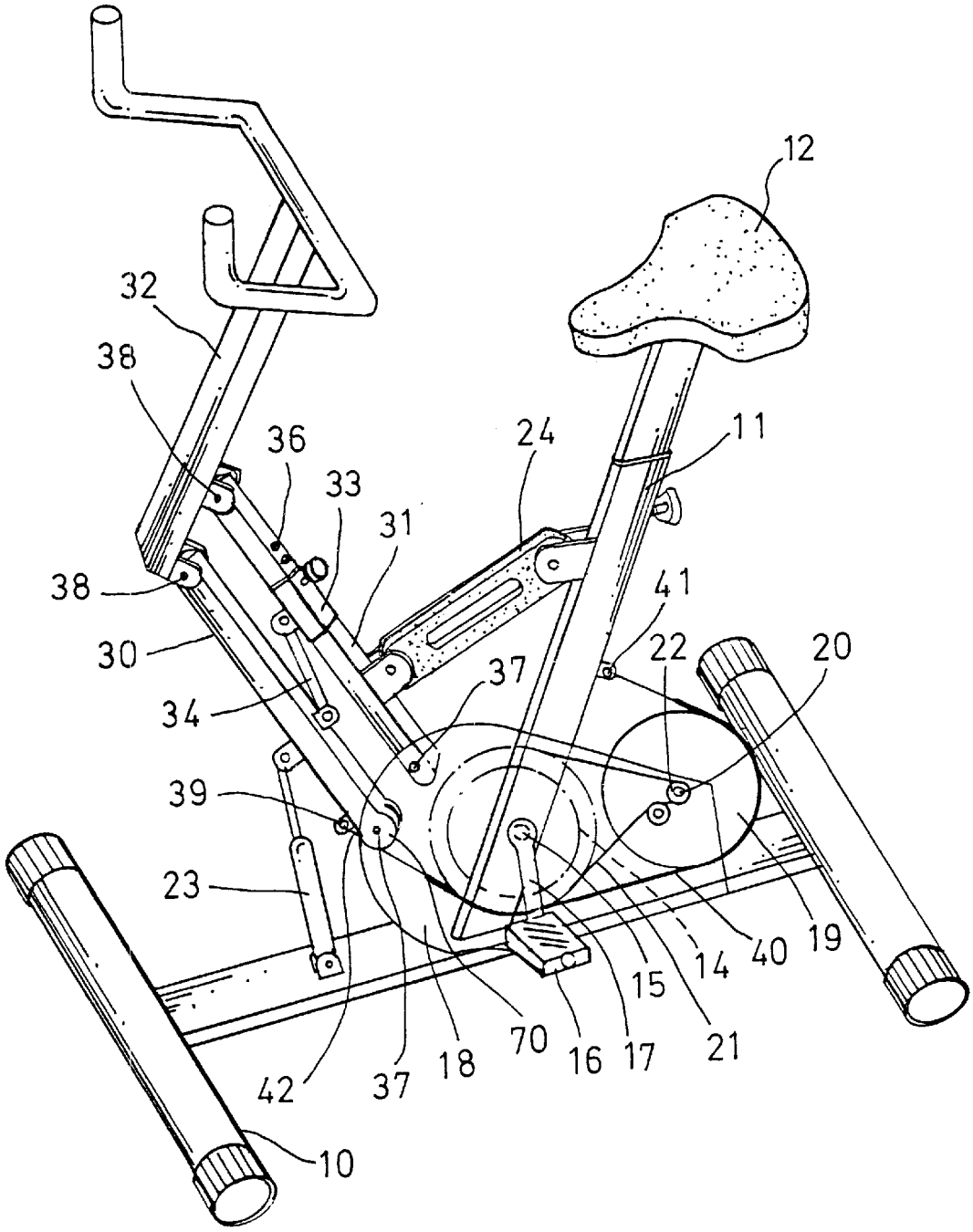
FIG. 8 is a perspective view illustrating the operation of the exerciser.

As best shown in FIG. 8, a fastener 35 may further be provided for selectively engaging with either of the apertures 36 of the lever 31, and for adjustably securing the sleeve 33 to the lever 31 and thus for securing the lever 31 to the handle stem 30, and thus for adjustably securing the handle stem 30 and the lever 31 at the selected angular position relative to the base 10 or the housing 18. The handle stem 30 and thus the hand grip 32 may not be rotated relative to the base 10 or the housing 18 when the sleeve 33 is secured to the lever 31.

Figure 6:
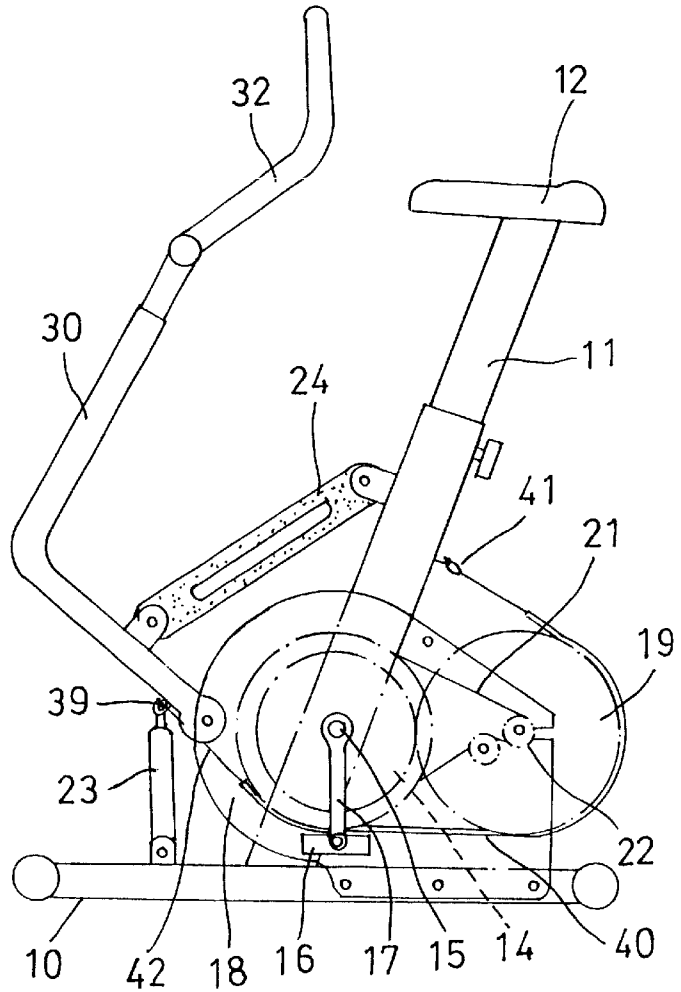
FIGS. 6 and 7 are plan schematic views similar to FIGS. 2 and 3, illustrating the other embodiment of the exerciser.
Figure 7:
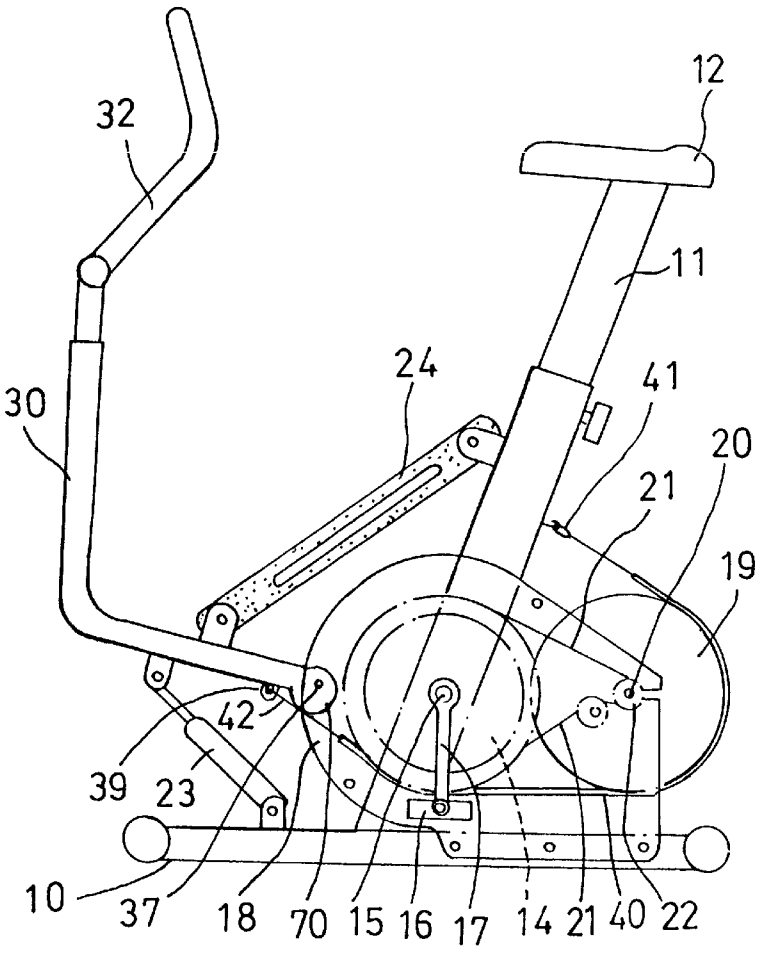

Referring next to FIGS. 6, and 7, the hand grip 32 may be directly secured to the handle stem 30 without the lever 31, such that the hand grip 32 and the handle stem 30 may also be rotated relative to the base 10 or the housing 18. The actuators 23 and/or the resilient members 24 may also be provided and attached to the handle stem 30 for applying the resistive force against the handle stem 30 and the hand grip 32.

The exerciser further includes a tension belt or a brake belt, or a brake cable 40 or the like engaged around the wheel or the rotary member 14 or 19 for braking purposes. For example, one end 41 of the brake cable 40 is secured to the base 10 or the housing 18 or the post 11, and is engaged around the wheel or the rotary member 14, and the other end 42 of the brake cable 40 may be secured to the handle stem 30 with such as a hook or a coupler 39 or the like. The handle stem 30 and the brake cable 40 are arranged for allowing the brake cable 40 to be moved away from or forced against the rotary member 19 when the handle stem 30 is rotated relative to the base 10 or the housing 18.

Figure 3:
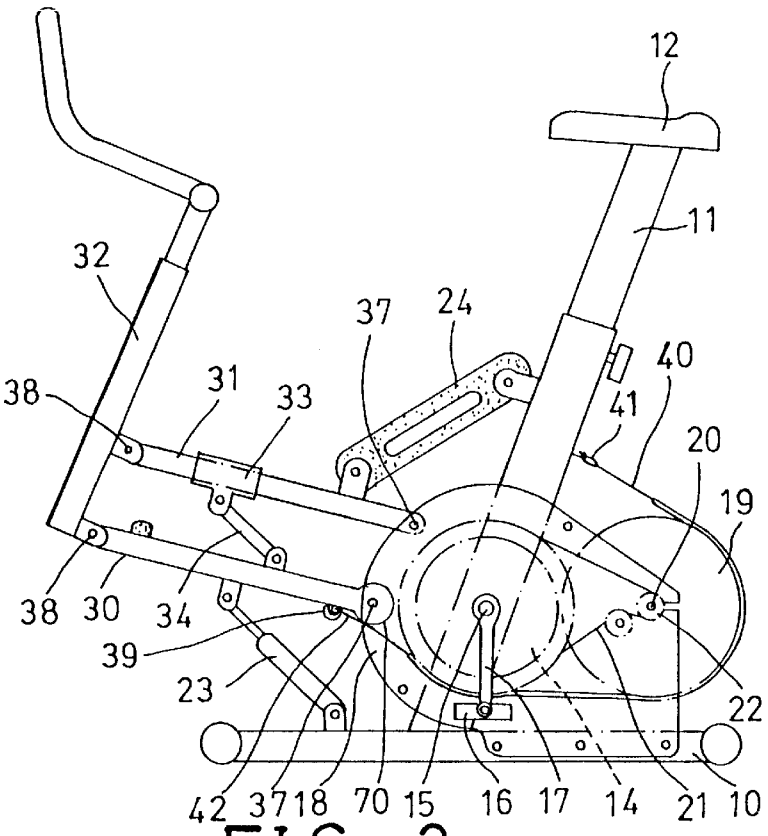
FIG. 3 is a plan schematic view similar to FIG. 2, illustrating the operation of the exerciser.
Figure 4:
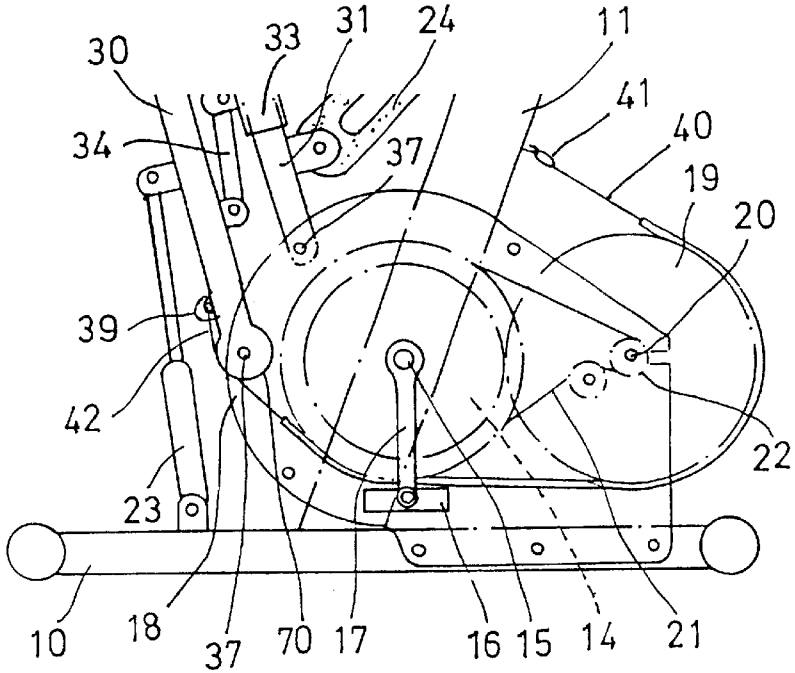
FIGS. 4 and 5 are enlarged partial plan schematic views similar to and corresponding to FIGS. 2 and 3, illustrating the operation of the exerciser.
Figure 5:
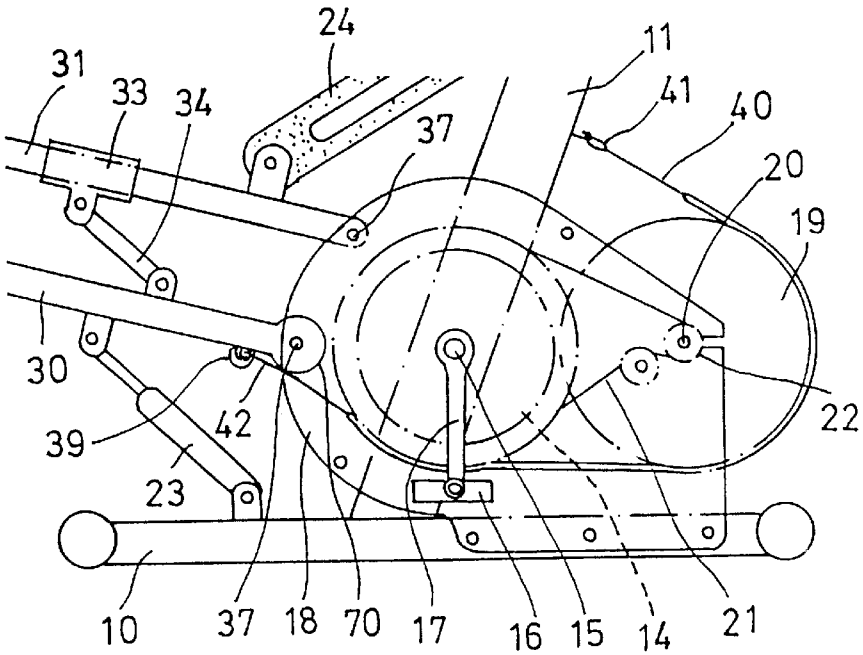

In operation, as shown in the drawings, when the users rotate the handle stem 30 and the hand grip 32 forward or away from them as shown in FIGS. 3, 5, 7, similar to ride or cruise down a hill, the brake cable 40 may be become loose relative to the rotary member 19, and the brake force of the brake cable 40 against the rotary member 19 may thus be decreased, such that the users may easily ride or actuate the exerciser with less force or energy.

On the contrary, when the users rotate the handle stem 30 and the hand grip 32 rearward or toward them as shown in FIGS. 1, 2, 4, 6, 8, similar to ride up or to climb up a hill, the brake cable 40 may be caused or forced to be further engaged onto the rotary member 19, and the brake force of the brake cable 40 against the rotary member 19 may thus be increased, such that the users have to spend more force or energy in order to ride or to climb or to actuate the exerciser.

The handle stem 30 may include a pulley or a rounded surface 70 formed and provided in the lower end thereof for engaging with the brake cable 40, and for stably and smoothly actuating the brake cable 40 to engage with or to act onto the rotary member 19, and for allowing the brake cable 40 to be effectively moved or operated or actuated by the handle stem 30.

Figure 9:
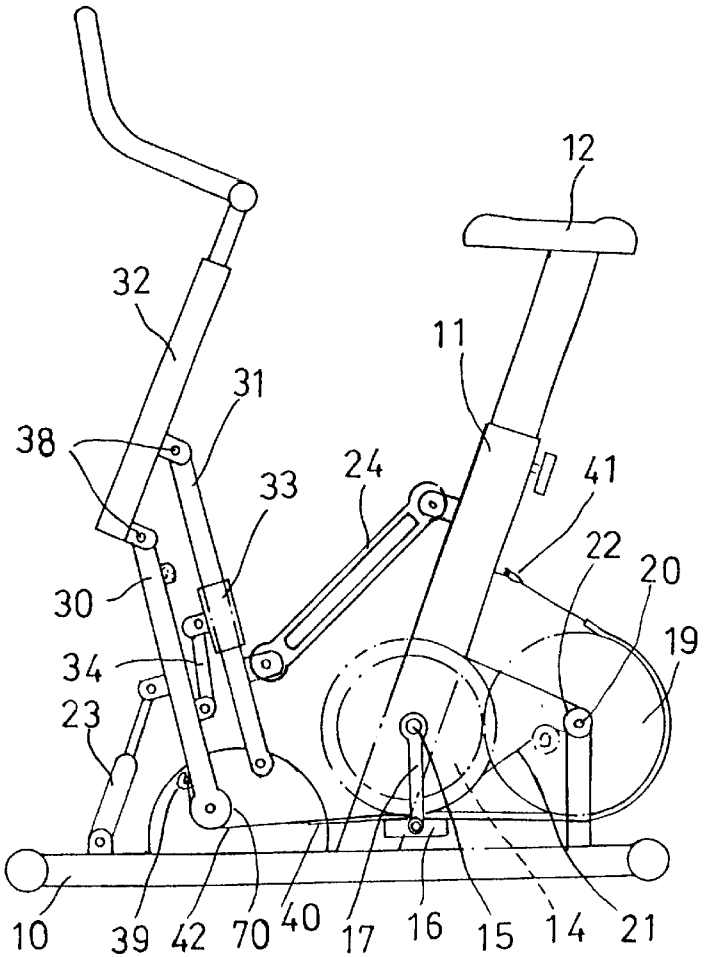
FIGS. 9, 10, 11 are perspective views illustrating the further embodiment of the exerciser.

It is to be noted that, as shown in FIG. 9, the handle stem 30 may be directly pivotally secured to the base 10 instead of to the housing 18 for shielding the rotary members 14, 19, and may also be coupled to the brake cable 40 for causing or actuating the brake cable 40 to be moved away from or forced against the rotary member 19 when the handle stem 30 is rotated relative to the base 10 or the housing 18. The brake cable 40 may be directly engaged around the rotary member 14 instead of engaging around the rotary member 19.

Figure 11:
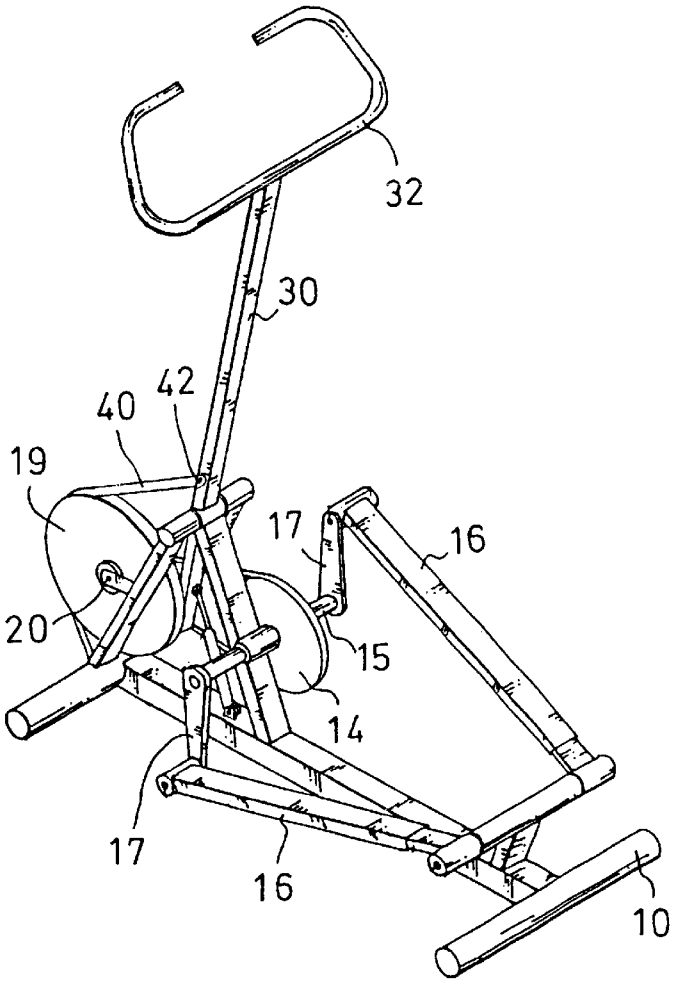
Figure 10:
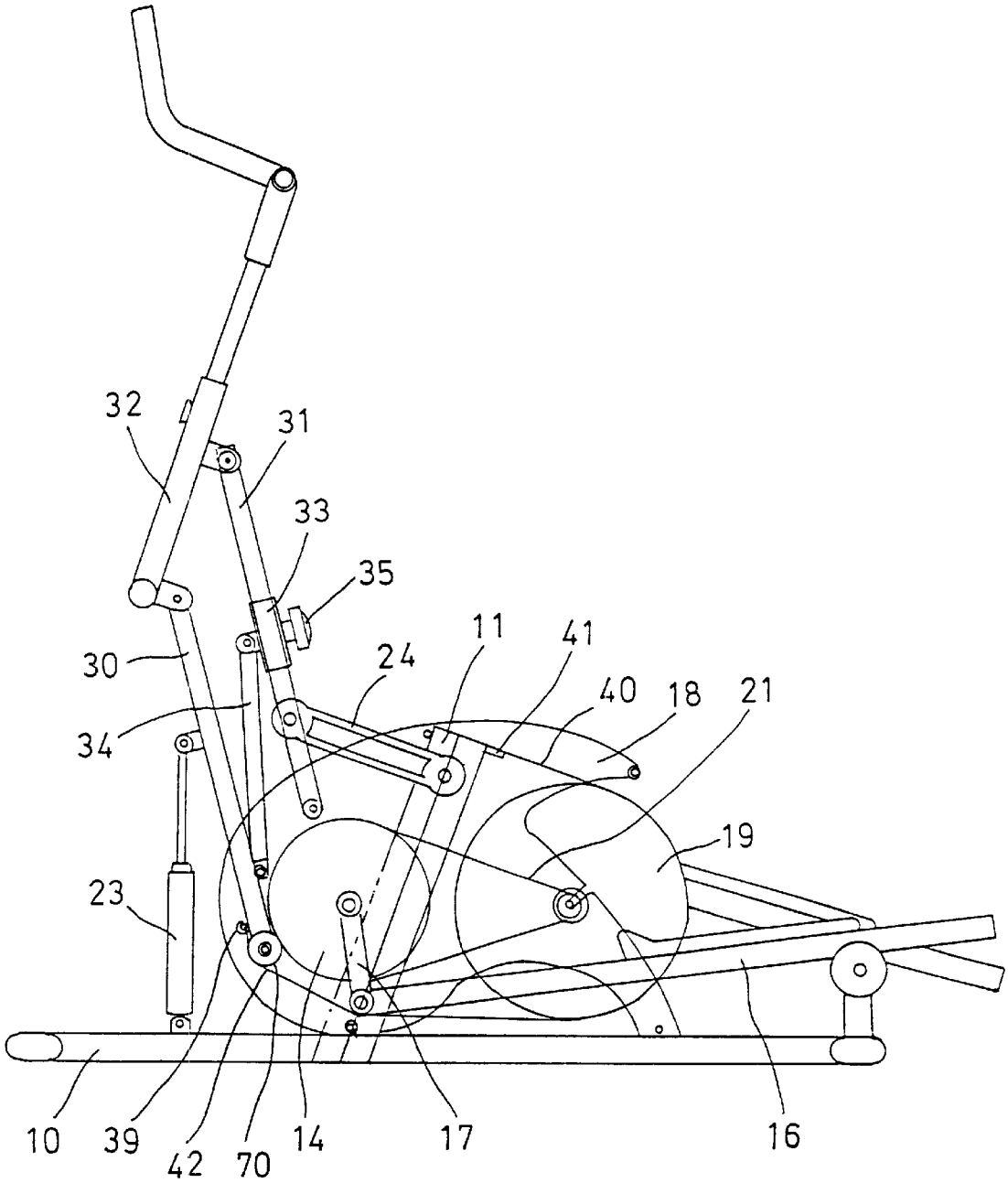

As shown in FIGS. 10 and 11, the rotary members 14 and/or 19 may be rotated or driven by the foot pedals of the stepping exercisers. The rotary members 14 and/or 19 may also be braked with the brake band or the brake cable 40 by rotating the handle stem 30 relative to the base 10. A brake cable actuatable disc brake device may further be provided for braking the rotary members 14, 19. The examples of the brake cable actuatable disc brake devices have been disclosed at least in U.S. Pat. No. 4,898,379 to Shiba, and U.S. Pat. No. 6,273,845 to Liou, which may be taken as a reference for the present invention.

Accordingly, the exerciser includes a simplified configuration having a pivotal handle for adjusting the resistance force applied to the exerciser.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An exerciser comprising:

a base, a first rotary member rotatably supported on said base, user exercise means comprising a second rotary member for driving said first rotary member, an elongated handle stem having one end pivotally supported on said base with a pivot pin and rotatable relative to said base about said pivot pin, and an opposite end having a pair of handles;

a brake cable provided for braking said first rotary member, and including a first end coupled to said handle stem, said brake cable arranged to be engaged with both said first and second rotary members when said handle stem is rotated relative to said base, in order to brake said rotary members; whereby the resistance applied to the user exercise means is adjustable.

2. The exerciser according to claim 1 further comprising a housing provided on said base, said handle stem being pivotally supported on said housing with said pivot pin and rotatable relative to said housing and said base about said pivot pin.

3. The exerciser according to claim 2 wherein said first rotary member is rotatably secured to said housing.

4. The exerciser according to claim 1, wherein said second rotary member is rotatably supported on said base, and includes means for coupling said second rotary member to said first rotary member.

5. The exerciser according to claim 4, wherein said coupling means includes a third rotary member secured to said first rotary member, and a coupling member engaged around said third and said second rotary members.

6. The exerciser according to claim 4 further comprising means for rotating said second rotary member.

7. The exerciser according to claim 6, wherein said rotating means includes a pair of cranks and foot pedals coupled to said second rotary member for rotating said second rotary member.

8. The exerciser according to claim 1 further comprising means for applying a resistance force against said handle stem.

9. The exerciser according to claim 1 wherein said a hand grip is pivotally secured to said handle stem, and a lever pivotally secured between said hand grip and said base and parallel to said handle stem.

10. The exerciser according to claim 9 further comprising a link pivotally coupled between said handle stem and said lever.

11. The exerciser according to claim 10 further comprising a sleeve slidably engaged on said lever, said link being pivotally coupled between said handle stem and said sleeve.

12. The exerciser according to claim 11 further comprising means for adjustably securing said sleeve on said lever, for adjustably securing said handle stem and said lever to said base at a selected angular position.

13. The exerciser according to claim 9 further comprising means for applying a resistance force against said lever.

14. The exerciser according to claim 13 further comprising a post extended from said base, said resistance force applying means including a resilient member coupled between said post and said lever.

* * * * *